US009242657B2

(12) United States Patent
Nishimura et al.

(10) Patent No.: US 9,242,657 B2
(45) Date of Patent: Jan. 26, 2016

(54) RAILCAR BOGIE

(71) Applicants: Takehiro Nishimura, Kobe (JP); Shunichi Nakao, Kobe (JP); Takeyoshi Kusunoki, Akashi (JP)

(72) Inventors: Takehiro Nishimura, Kobe (JP); Shunichi Nakao, Kobe (JP); Takeyoshi Kusunoki, Akashi (JP)

(73) Assignee: KAWASAKI JUKOGYO KABUSHIKI KAISHA, Kobe-Shi, Hyogo (JP)

( * ) Notice: Subject to any disclaimer, the term of this patent is extended or adjusted under 35 U.S.C. 154(b) by 72 days.

(21) Appl. No.: 14/154,328

(22) Filed: Jan. 14, 2014

(65) Prior Publication Data

US 2014/0123870 A1 May 8, 2014

Related U.S. Application Data

(62) Division of application No. 14/232,295, filed as application No. PCT/JP2012/004514 on Jul. 12, 2012.

(30) Foreign Application Priority Data

Jul. 14, 2011 (JP) ..... 2011-155609
Mar. 29, 2012 (JP) ..... 2012-076652

(51) Int. Cl.
*B61F 5/30* (2006.01)
*B61F 5/50* (2006.01)
*B61F 5/52* (2006.01)

(52) U.S. Cl.
CPC . *B61F 5/30* (2013.01); *B61F 5/302* (2013.01); *B61F 5/50* (2013.01); *B61F 5/52* (2013.01)

(58) Field of Classification Search
CPC ..... B61F 5/30; B61F 5/302; B61F 5/50; B61F 5/52
USPC ..... 105/197.05
See application file for complete search history.

(56) References Cited

U.S. PATENT DOCUMENTS 2,098,459 A 11/1937 McWhirter
3,948,188 A 4/1976 Zehnder
(Continued)

FOREIGN PATENT DOCUMENTS

EP 1 538 056 A1 6/2005
GB 2091660 A 8/1982
JP A-47-654 1/1972
(Continued)

OTHER PUBLICATIONS

Extended European Search Report issued in European Application No. 14156449.2 dated Aug. 12, 2014.
(Continued)

*Primary Examiner* — Zachary Kuhfuss
(74) *Attorney, Agent, or Firm* — Oliff PLC

(57) ABSTRACT

A plate spring bogie includes: a cross beam supporting a carbody of a railcar; a pair of front and rear axles sandwiching and respectively arranged in front of and behind the cross beam in a railcar longitudinal direction to extend in a railcar width direction; bearings respectively provided at both railcar width direction sides of each of the axles and rotatably supporting the axles; axle boxes respectively accommodating the bearings; plate springs extending in the railcar longitudinal direction to respectively support both railcar width direction end portions of the cross beam and each including both railcar longitudinal direction end portions respectively supported by the axle boxes; and an auxiliary supporting mechanism supporting the railcar width direction end portion of the cross beam in a case where the railcar width direction end portion of the cross beam is displaced downward beyond a predetermined elastic deformation range of the plate spring.

6 Claims, 16 Drawing Sheets

(56) References Cited

U.S. PATENT DOCUMENTS

| | | | |
|---|---|---|---|
| 6,338,300 | B1 | 1/2002 | Landrot |
| 7,328,660 | B2 | 2/2008 | Landrot |
| 2005/0116436 | A1 | 6/2005 | Landrot |

FOREIGN PATENT DOCUMENTS

| | | |
|---|---|---|
| JP | U-53-158007 | 12/1978 |
| JP | A-55-47950 | 4/1980 |
| JP | B2-2799078 | 9/1998 |
| JP | A-11-198809 | 7/1999 |
| JP | 2013-035536 A | 2/2013 |

OTHER PUBLICATIONS

International Search Report issued in International Patent Application No. PCT/JP2012/004514 dated Oct. 23, 2012.

Pending U.S. Appl. No. 14/232,295, filed Jan. 13, 2014.

Jun. 10, 2015 Office Action issued in U.S. Appl. No. 14/232,295.

May 7, 2015 Extended Search Report issued in European Application No. 12811394.1.

Sep. 17, 2015 Office Action issued in Chinese Patent Application No. 201410041535.3.

Sep. 17, 2015 Search Report issued in Chinese Patent Application No. 201410041535.3.

Sep. 22, 2015 Office Action issued in U.S. Appl. No. 14/232,295.

RAILCAR BOGIE

This is a Divisional of application Ser. No. 14/232,295 filed Jan. 13, 2014, which in turn is a National Phase of Application No. PCT/JP2012/004514 filed Jul. 12, 2012, which claims the benefit of Japanese Applications No. 2011-155609 filed Jul. 14, 2011 and 2012-076652 filed Mar. 29, 2012. The disclosures of the prior applications are hereby incorporated by reference herein in their entirety.

TECHNICAL FIELD

The present invention relates to a railcar bogie from which side sills are omitted.

BACKGROUND ART

A bogie for supporting a carbody of a railcar and allowing the railcar to run along a rail is provided under a floor of the carbody. In the bogie, axle boxes each configured to store a bearing for supporting an axle are supported by an axlebox suspension so as to be displaceable relative to a bogie frame in an upper-lower direction. For example, PTL 1 proposes the axlebox suspension, and the bogie frame includes a cross beam extending in a crosswise direction and a pair of left and right side sills respectively extending from both end portions of the cross beam in a front-rear direction. The axlebox suspension includes axle springs constituted by coil springs each provided between the axle box and the side sill located above the axle box.

PTL 2 proposes the bogie in which the side sills are omitted from the bogie frame.

CITATION LIST

Patent Literature

PTL 1: Japanese Patent No. 2799078

PTL 2: Japanese Laid-Open Patent Application Publication No. 55-47950

SUMMARY OF INVENTION

Technical Problem

In the bogie of PTL 1, the bogie frame constituted by the cross beam and the side sills is manufactured by, for example, welding heavy steel members to one another. Therefore, problems are that the weight of the bogie frame becomes heavy, and the cost for the steel members and the assembly cost become high.

In the bogie of PTL 2, the cross beam of the bogie frame and each axle box are connected to each other by a suspension member so as to be spaced apart from each other by a certain distance. In addition, front-rear direction middle portions of plate springs are respectively held by and fixed to both crosswise direction end portions of the cross beam, and both front-rear direction end portions of each plate spring are respectively inserted in spring receiving portions respectively provided at lower portions of the axle boxes.

However, in the case of the bogie of PTL 2, if one of the left and right plate springs is damaged, such as if one of the left and right plate springs breaks, the damaged plate spring does not achieve a designed supporting function, and one crosswise direction end portion of the cross beam moves downward beyond expectation. There may be a case where: a large number of plate springs are provided; and even if a part of the plate springs are damaged, the rest of the plate springs ensure the adequate supporting function. However, since the spring constant of the plate spring needs to meet the requirement of design, a larger number of plate springs cannot be provided in many cases.

Here, an object of the present invention is to improve the reliability of a plate spring bogie by appropriately supporting a cross beam even if the plate spring is, for example, damaged.

Solution to Problem

A railcar bogie according to the present invention includes: a cross beam configured to support a carbody of a railcar; a pair of front and rear axles sandwiching the cross beam and respectively arranged in front of and behind the cross beam in a railcar longitudinal direction so as to extend in a railcar width direction; bearings respectively provided at both railcar width direction sides of each of the axles and configured to rotatably support the axles: axle boxes configured to respectively accommodate the bearings; plate springs extending in the railcar longitudinal direction so as to respectively support both railcar width direction end portions of the cross beam and each including both railcar longitudinal direction end portions respectively supported by the axle boxes; and an auxiliary supporting mechanism configured to, in a case where at least one of both railcar width direction end portions of the cross beam is displaced downward beyond a predetermined elastic deformation range of the plate spring, support said one end portion of the cross beam.

According to the above configuration, if the plate spring is, for example, damaged, and this causes the crosswise direction end portion of the cross beam to be displaced downward beyond the predetermined elastic deformation range of the plate spring, the auxiliary supporting mechanism supports the end portion of the cross beam, so that the required supporting function can be ensured by the auxiliary supporting mechanism. Therefore, even if the plate spring is, for example, damaged, the cross beam can be appropriately supported. Thus, the reliability of the plate spring bogie can be improved.

Advantageous Effects of Invention

As is clear from the above explanations, according to the present invention, even if the plate spring is, for example, damaged, the cross beam can be appropriately supported. Thus, the reliability of the plate spring bogie can be improved.

DESCRIPTION OF EMBODIMENTS

Hereinafter, embodiments according to the present invention will be explained in reference to the drawings.

Embodiment 1

Figure 1:
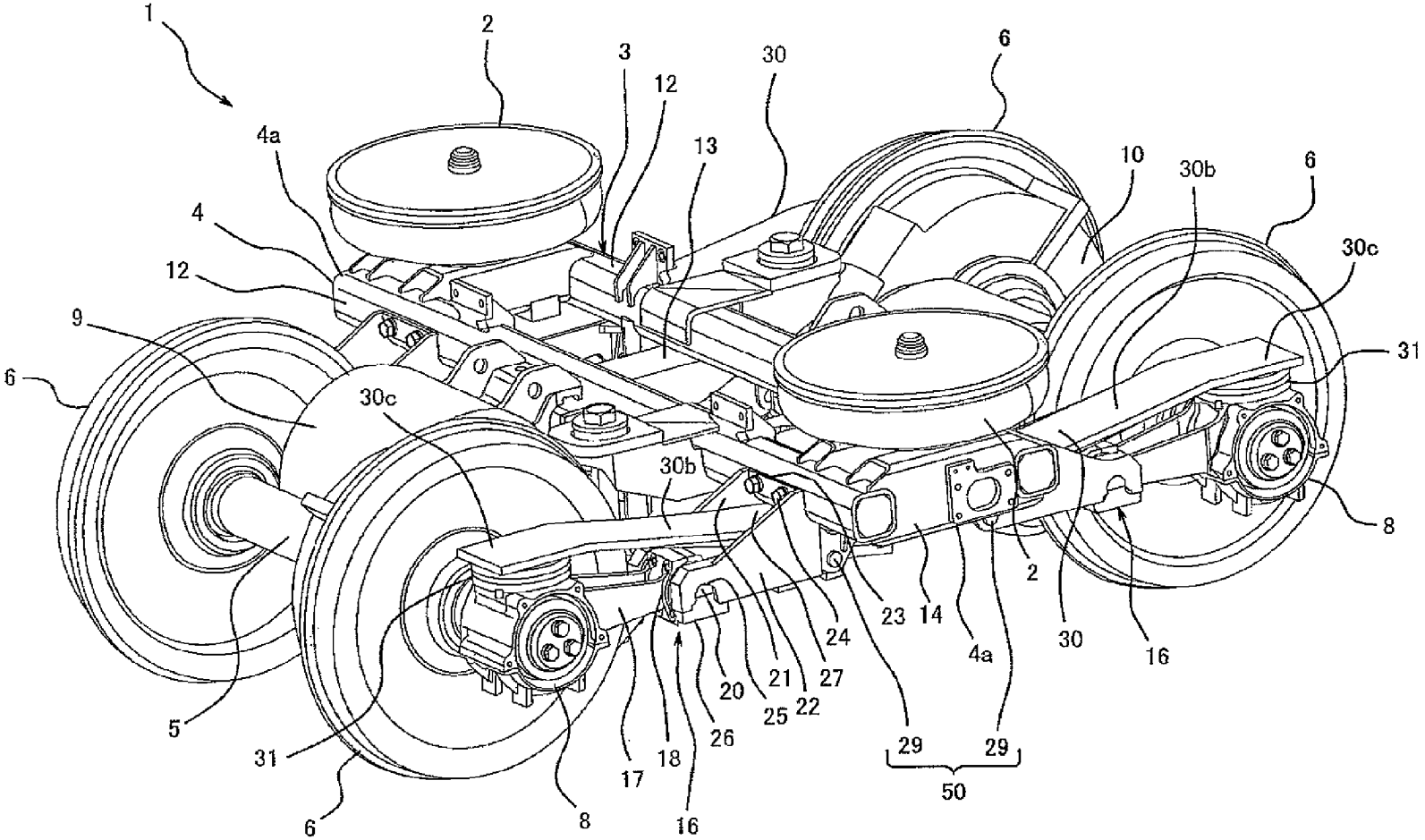
FIG. 1 is a perspective view showing a railcar bogie according to Embodiment 1 of the present invention.
Figure 2:
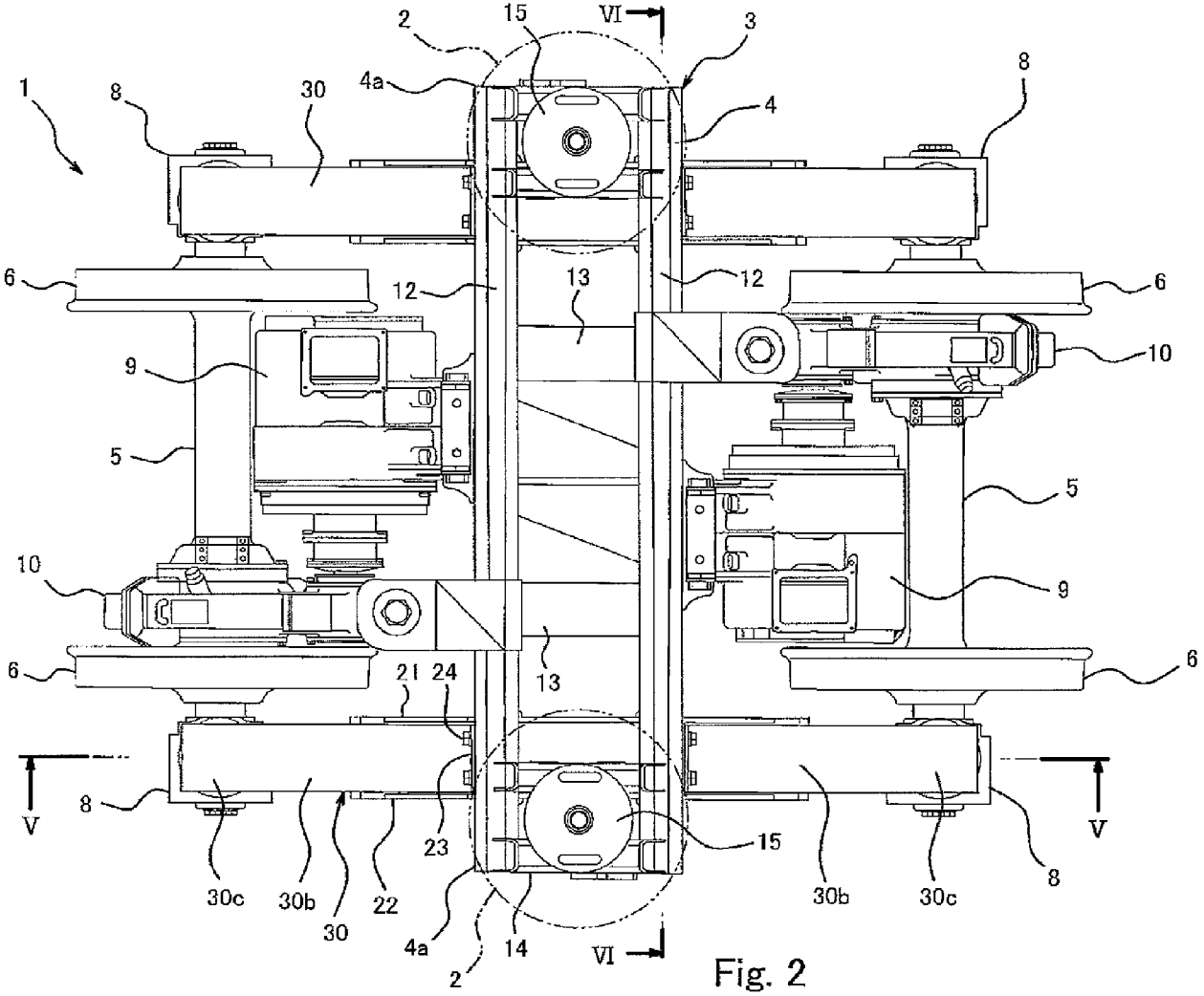
FIG. 2 is a plan view of the bogie shown in FIG. 1.
Figure 3:
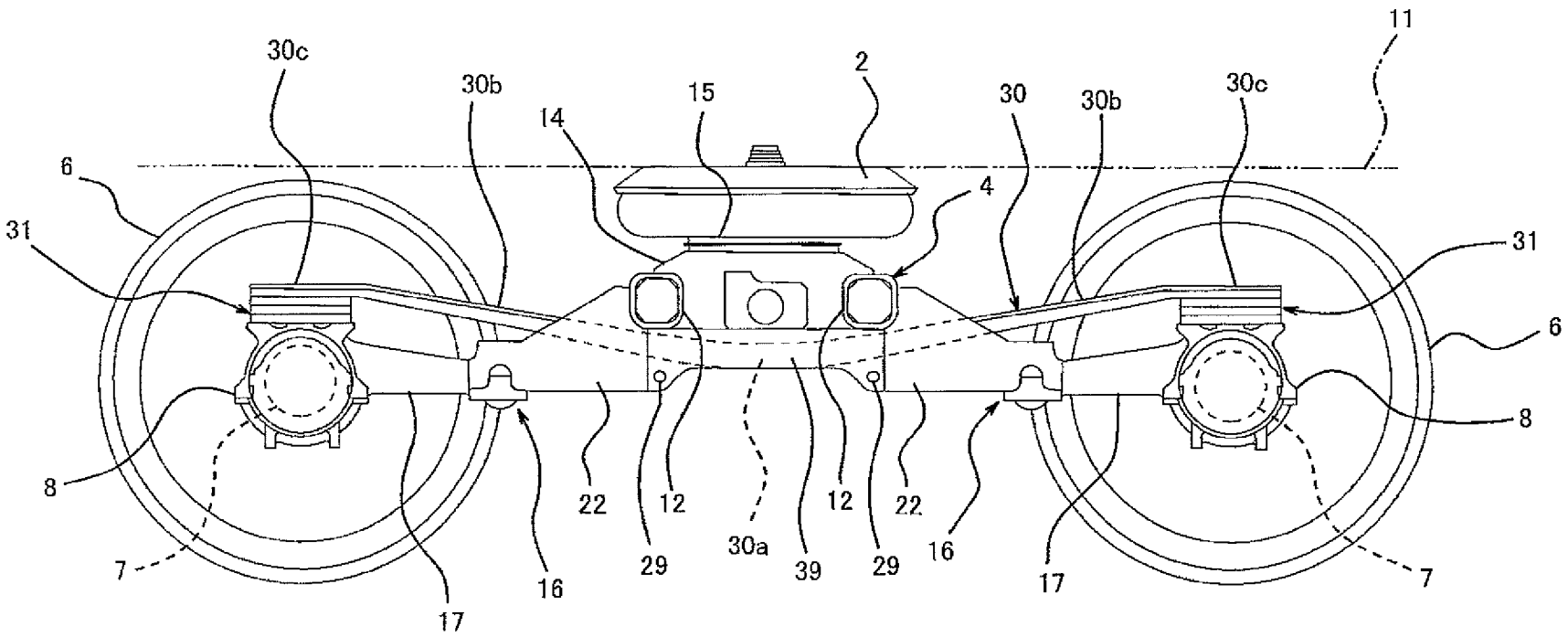
FIG. 3 is a side view of the bogie shown in FIG. 1.
Figure 4:
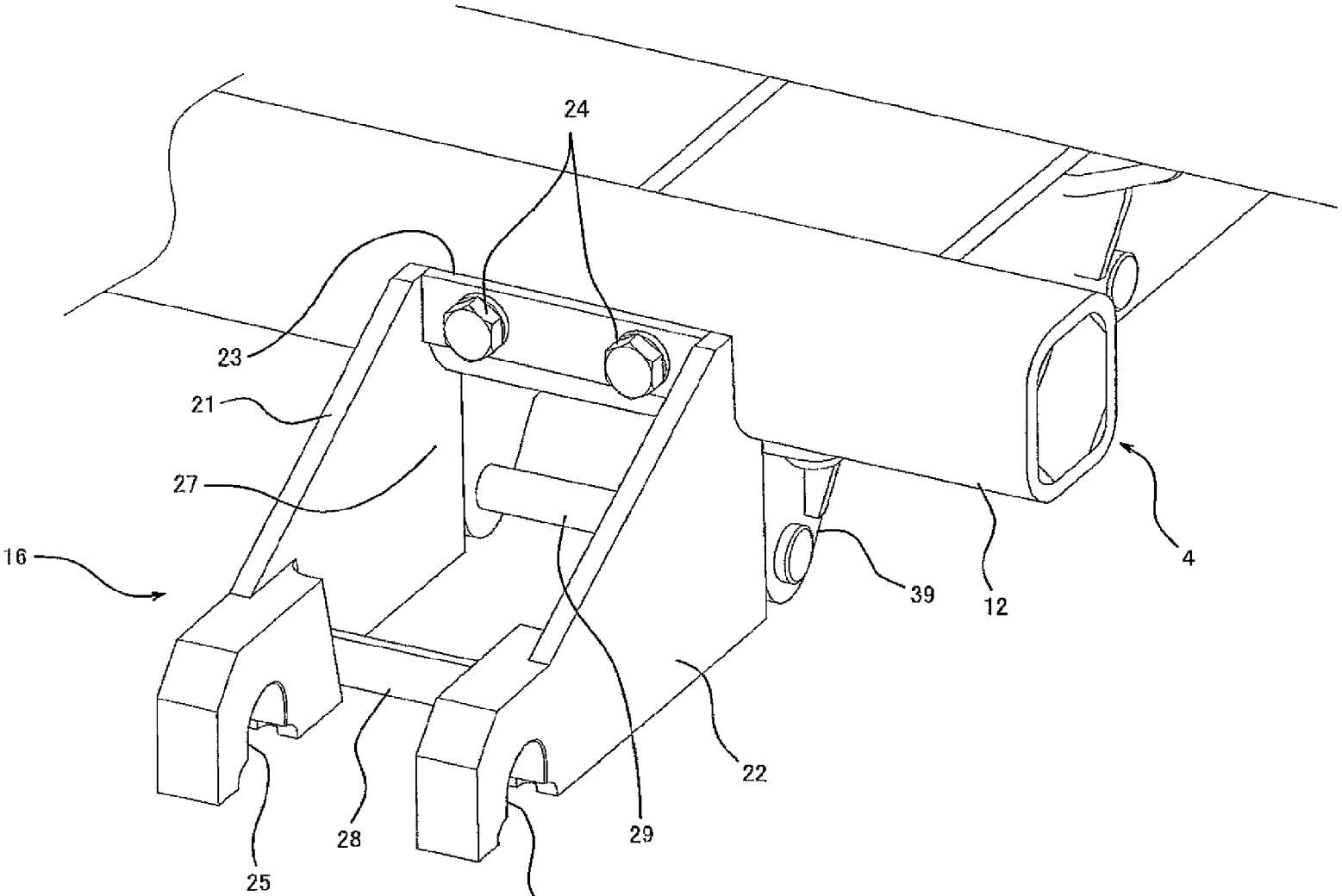
FIG. 4 is a perspective view showing receiving seats of a coupling mechanism shown in FIG. 1 and their vicinities.

FIG. 1 is a perspective view showing a railcar bogie 1 according to Embodiment 1 of the present invention. FIG. 2 is a plan view of the bogie 1 shown in FIG. 1. FIG. 3 is a side view of the bogie 1 shown in FIG. 1. FIG. 4 is a perspective view showing receiving seats 21 and 22 of a coupling mechanism 16 shown in FIG. 1 and their vicinities. As shown in FIGS. 1 to 3, the railcar bogie 1 includes a cross beam 4 extending in a railcar width direction (hereinafter also referred to as a "crosswise direction") as a bogie frame 3 configured to support a carbody 11 via air springs 2 serving as secondary suspensions. However, the railcar bogie 1 does not include side sills respectively extending from both crosswise direction end portions of the cross beam 4 in a railcar longitudinal direction (hereinafter also referred to as a "front-rear direction"). A pair of front and rear axles 5 are respectively arranged in front of and behind the cross beam 4 so as to extend in the crosswise direction. Wheels 6 are respectively fixed to both crosswise direction sides of each axle 5. Bearings 7 configured to rotatably support the axle 5 are respectively provided at both crosswise direction end portions of the axle 5 so as to be respectively located outside the wheels 6 in the crosswise direction. The bearings 7 are respectively accommodated in axle boxes 8. An electric motor 9 is attached to the cross beam 4, and a gear box 10 that accommodates a reduction gear configured to transmit power to the axles 5 is connected to an output shaft of the electric motor 9. A braking device (not shown) configured to brake the rotations of the wheels 6 is also provided at the cross beam 4.

The cross beam 4 includes: a pair of square pipes 12 extending in the crosswise direction and made of metal; and connecting plates 13 and 14 connecting the square pipes 12 and made of metal. The connecting plates 13 and 14 are fixed to the square pipes 12 by bolts, or the like. A pair of tubular connecting plates 14 are provided at each of crosswise direction end portions 4*a* of the cross beam 4 so as to be spaced apart from each other. Each of air spring bases 15 is disposed on upper surfaces of the pair of connecting plates 14. Each of the crosswise direction end portions 4*a* of the cross beam 4 is coupled to the axle boxes 8 by coupling mechanisms 16. Each of the coupling mechanisms 16 includes an axle beam 17 extending in the front-rear direction integrally from the axle box 8. A tubular portion 18 that has a cylindrical inner peripheral surface and opens at both crosswise direction sides thereof is provided at an end portion of each axle beam 17. A core rod 20 is inserted through an internal space of each tubular portion 18 via a rubber bushing (not shown).

As shown in FIGS. 1 and 4, a pair of receiving seats 21 and 22 constituting the coupling mechanism 16 are provided at the crosswise direction end portion 4*a* of the cross beam 4 so as to project in the front-rear direction. Upper end portions of the pair of receiving seats 21 and 22 are coupled to each other by an upper coupling plate 23, and the upper coupling plate 23 is fixed to the square pipe 12 by bolts 24. In addition, projecting tip ends of lower end portions of the receiving seats 21 and 22 are coupled to each other by a lower coupling plate 28. A fitting groove 25 that opens downward is formed at each of the receiving seats 21 and 22. Both crosswise direction end portions of the core rod 20 are respectively fitted into the fitting grooves 25 of the receiving seats 21 and 22 from below. In this state, a lid member 26 is fixed to the receiving seats 21 and 22 by bolts (not shown) from below so as to close lower openings of the fitting grooves 25 of the receiving seats 21 and 22. Thus, the core rod 20 is supported by the lid member 26 from below.

Each of plate springs 30 extending in the front-rear direction is provided between the cross beam 4 and the axle box 8. Front-rear direction middle portions 30*a* of the plate springs 30 respectively support the crosswise direction end portions 4*a* of the cross beam 4, and front-rear direction end portions 30*c* of the plate springs 30 are respectively supported by the axle boxes 8. To be specific, each of the plate springs 30 serves as both a primary suspension and a conventional side sill. Spring seats 31 are respectively attached to upper end portions of the axle boxes 8, and the front-rear direction end portions 30*c* of the plate springs 30 are respectively supported by the spring seats 31 from below. The front-rear direction middle portions 30*a* of the plate springs 30 are arranged under the cross beam 4, and contact members 33 (see FIG. 5) respectively provided at the crosswise direction end portions 4*a* of the cross beam 4 are respectively disposed on the front-rear direction middle portions 30*a* of the plate springs 30 from above.

In the plate spring 30, each of extending portions 30*b* each extending between the front-rear direction middle portion 30*a* and the front-rear direction end portion 30*c* is inclined downward toward the front-rear direction middle portion 30*a* in a side view. To be specific, the front-rear direction middle portion 30*a* of the plate spring 30 is located at a position lower than the front-rear direction end portion 30*c* of the plate spring 30. A part of each of the extending portions 30*b* of the plate spring 30 is arranged so as to overlap the coupling mechanism 16 in a side view while being spaced apart from the coupling mechanism 16. Specifically, a part of the extending portion 30*b* of the plate spring 30 extends through a space 27 sandwiched between the pair of receiving seats 21 and 22 and also extends under the upper coupling plate 23 and above the lower coupling plate 28. The front-rear direction middle portion 30*a* of the plate spring 30 is located in a space under the cross beam 4 and above first auxiliary supporting members 29 described below.

Figure 5:
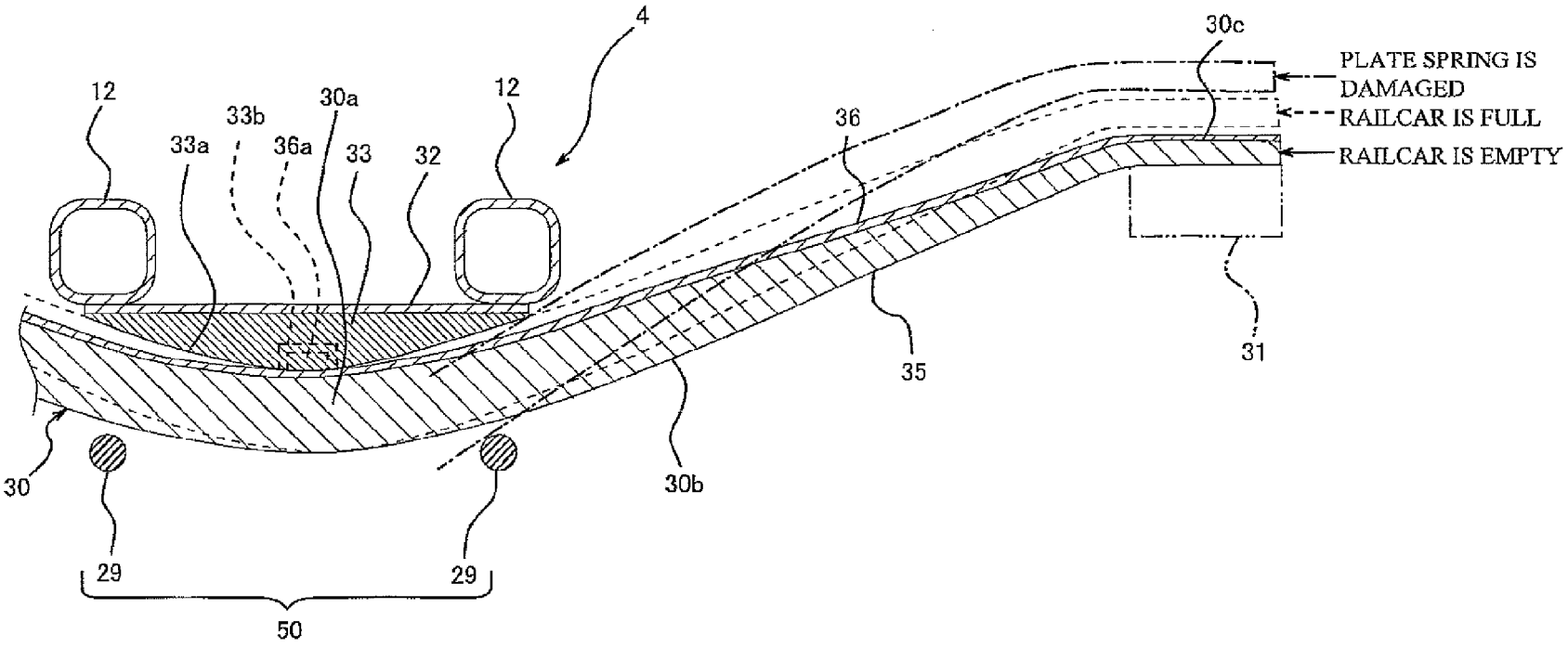
FIG. 5 is a main portion cross-sectional view taken along line V-V of FIG. 2 and showing a cross beam, a plate spring, and auxiliary supporting members.
Figure 6:
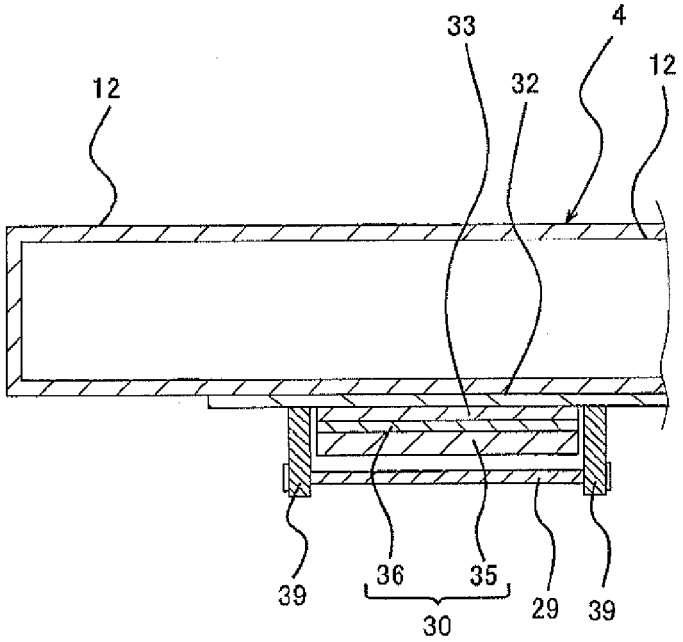
FIG. 6 is a cross-sectional view taken along line VT-VI of FIG. 2.

FIG. 5 is a main portion cross-sectional view taken along line V-V of FIG. 2 and showing the cross beam 4, the plate spring 30, and the first auxiliary supporting members 29. FIG. 6 is a cross-sectional view taken along line VI-VI of FIG. 2. As shown in FIGS. 5 and 6, a fixing plate 32 fixed to lower surfaces of the pair of square pipes 12 and made of metal (such as a general steel material) and the contact member 33 fixed to a lower surface of the fixing plate 32 and constituted by a rigid body (such as metal or fiber-reinforced resin) are provided at each of the crosswise direction end portions 4*a* of the cross beam 4. The contact member 33 does not support a lower surface of the plate spring 30. To be specific, the contact member 33 is disposed on the front-rear direction middle portion 30*a* of the plate spring 30 from above so as to freely contact the front-rear direction middle portion 30*a*. In other words, the contact member 33 contacts an upper surface of the plate spring 30 so as not to fix the plate spring 30 in the upper-lower direction.

Each of the front-rear direction end portions 30*c* of the plate spring 30 is located at a position higher than a contact surface 33*a* that is a lower surface of the contact member 33 of the cross beam 4. The contact surface 33*a* contacting the plate spring 30 has a substantially circular-arc shape that is convex downward in a side view. In a state where the bogie 1 is not supporting the carbody 11, the curvature of the contact surface 33*a* of the contact member 33 is larger than that of a portion of the plate spring 30 in a side view, the portion contacting the contact member 33. In a state where the bogie 1 is supporting the carbody 11, the plate spring 30 elastically deforms by the downward load from the carbody 11 such that the cross beam 4 moves downward, and the curvature of the portion, contacting the contact member 33, of the plate spring 30 increases. However, when the railcar is empty, the curvature of the contact surface 33*a* of the contact member 33 is kept larger than that of the portion, contacting the contact member 33, of the plate spring 30 (solid line in FIG. 5). As the number of passengers in the carbody 11 increases, and this increases the downward load applied to the cross beam 4, the curvature of the portion, contacting the contact member 33, of the plate spring 30 increases (broken line in FIG. 5).

The plate spring 30 has a double-layer structure and includes a lower layer portion 35 made of fiber-reinforced resin (such as CFRP or GFRP) and an upper layer portion 36 that is thinner than the lower layer portion 35 and made of metal (such as a general steel material). In other words, the plate spring 30 is formed such that an upper surface of a plate spring main body portion (lower layer portion 35) made of fiber-reinforced resin is integrally covered with metal (upper layer portion 36). The extending portion 30*b* of the plate spring 30 is formed such that a thickness T thereof gradually increases in a direction from a front-rear direction end portion toward a middle portion. A concave-convex fitting structure including fitting portions that are fitted to each other in the upper-lower direction with a play is provided at a portion where the contact surface 33*a* of the contact member 33 and the upper surface of the plate spring 30 contact each other. Specifically, a concave portion 33*b* that is concave upward is formed at a middle portion of the contact surface 33*a* of the contact member 33, and a convex portion 36*a* that is fitted to the concave portion 33*b* with a play is formed on an upper surface of the upper layer portion 36 of the plate spring 30.

A pair of guide side walls 39 respectively projecting downward from both crosswise direction sides of the contact member 33 are provided at the cross beam 4 so as to be spaced apart from each other, and the plate spring 30 is arranged between the guide side walls 39 so as to be spaced apart from the guide side walls 39. The pair of guide side walls 39 are coupled to each other by the first auxiliary supporting members 29 that are respectively located at a front side and a rear side when viewed from a front-rear direction center of the plate spring 30, each extends in the crosswise direction, and each has a columnar shape. The first auxiliary supporting members 29 are symmetrically arranged at the front side and the rear side and constitute an auxiliary supporting mechanism 50 configured to, if the plate spring 30 is damaged, such as if the plate spring 30 breaks, support the end portion 4*a* of the cross beam 4 by sandwiching the plate spring 30 between the auxiliary supporting mechanism 50 and the contact member 33 of the end portion 4*a* of the cross beam 4.

The first auxiliary supporting members 29 are arranged under the plate spring 30 so as to overlap the end portion 4*a* of the cross beam 4 in a plan view. A distance L1 between the pair of first auxiliary supporting members 29 at the front side and the rear side is shorter than a front-rear direction length L2 of the contact member 33 of the end portion 4*a* of the cross beam 4. In a case where the plate spring 30 is not damaged, and the end portion 4*a* of the cross beam 4 is normally displaced in the upper-lower direction within a predetermined elastic deformation range of the plate spring 30, the first auxiliary supporting members 29 are separated from the plate spring 30 and do not support the end portion 4*a* of the cross beam 4. To be specific, the first auxiliary supporting members 29 are arranged at such positions as to be separated from the plate spring 30, that is, as not to contact the plate spring 30 while the cross beam 4 is displaced relative to the axle box 8 in the upper-lower direction since the plate spring 30 elastically deforms between a deformation state (solid line in FIG. 5) when the vehicle occupancy of the carbody 11 is 0%, that is, the carbody 11 is empty and a deformation state (broken line in FIG. 5) when the vehicle occupancy of the carbody 11 is 100%, that is, the carbody 11 is full.

If there occurred an abnormality in which the front-rear direction middle portion 30*a* of the plate spring 30 does not extend along the lower surface of the contact member 33 due to the damage, such as break, of the vicinity of the front-rear direction center of the plate spring 30, the front-rear direction middle portion 30*a* (a portion of the plate spring 30, the portion overlapping the cross beam 4 in a plan view) of the plate spring 30 inclines beyond the normal elastic deformation range and is positioned so as to be sandwiched between the auxiliary supporting member 29 and a front-rear direction end edge of the contact member 33 in the upper-lower direction by the downward load applied from the cross beam 4 (dashed line in FIG. 5).

To be specific, when the plate spring 30 inclines beyond the elastic deformation range, the contact member 33 of the railcar width direction end portion of the cross beam 4 supports the upper surface of the plate spring 30, and the first auxiliary supporting members 29 support the lower surface of the plate spring 30. With this, the first auxiliary supporting members 29 support the end portion 4*a* of the cross beam 4 via the plate spring 30.

In addition, in a case where the plate spring 30 is damaged at a portion other than the front-rear direction middle portion 30*a*, such as in a case where the plate spring 30 breaks at the portion, the first auxiliary supporting members 29 support the end portion 4*a* of the cross beam 4 via a remaining longer portion of the plate spring 30. For example, in a case where the extending portion 30*b* at the front side breaks, a portion, located at the rear side of the broken point, of the plate spring 30 inclines beyond the normal elastic deformation range and is positioned so as to be sandwiched between the first auxiliary supporting member 29 and the contact member 33 in the upper-lower direction by the downward load applied from the cross beam 4. With this, the auxiliary supporting members 29 support the end portion 4*a* of the cross beam 4 via the portion, located at the rear side of the broken point, of the plate spring 30.

In FIG. 5, the damaged plate spring 30 is positioned so as to be sandwiched between the front-rear direction end edge of the contact member 33 and the first auxiliary supporting member 29. However, the damaged plate spring 30 may be positioned so as to be sandwiched between the front-rear direction end edge of the square pipe 12 and the first auxiliary supporting member 29. In a state where the auxiliary supporting members 29 support one end portion 4*a* of the cross beam 4 via the plate spring 30, the end portion 4*a* of the cross beam 4 is slightly displaced downward more than usual. However, the height and posture of the carbody 11 can be corrected by increasing the amount of expansion of the corresponding air spring 2.

Figure 7:
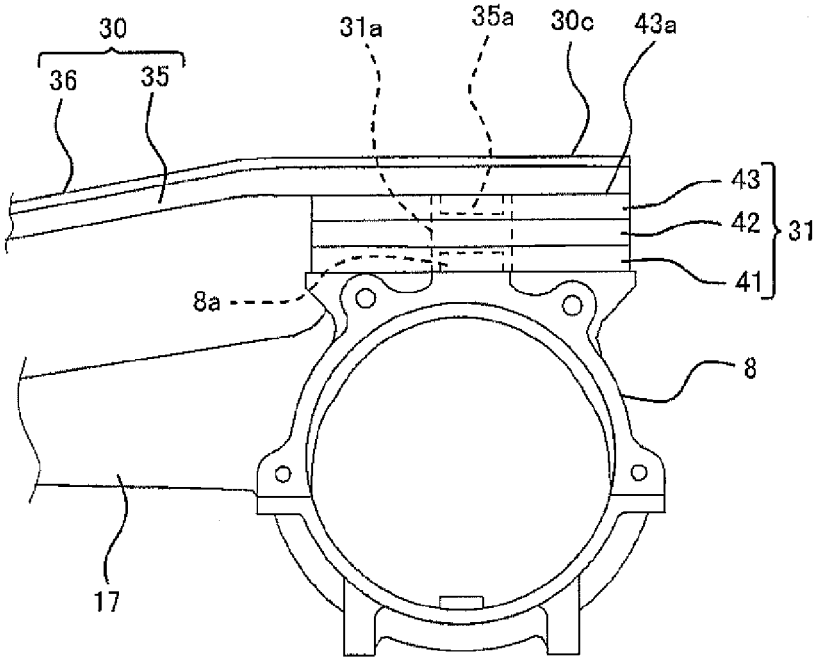
FIG. 7 is a main portion side view showing the plate spring and a supporting member of an axle box in the bogie shown in FIG. 3.
Figure 8:
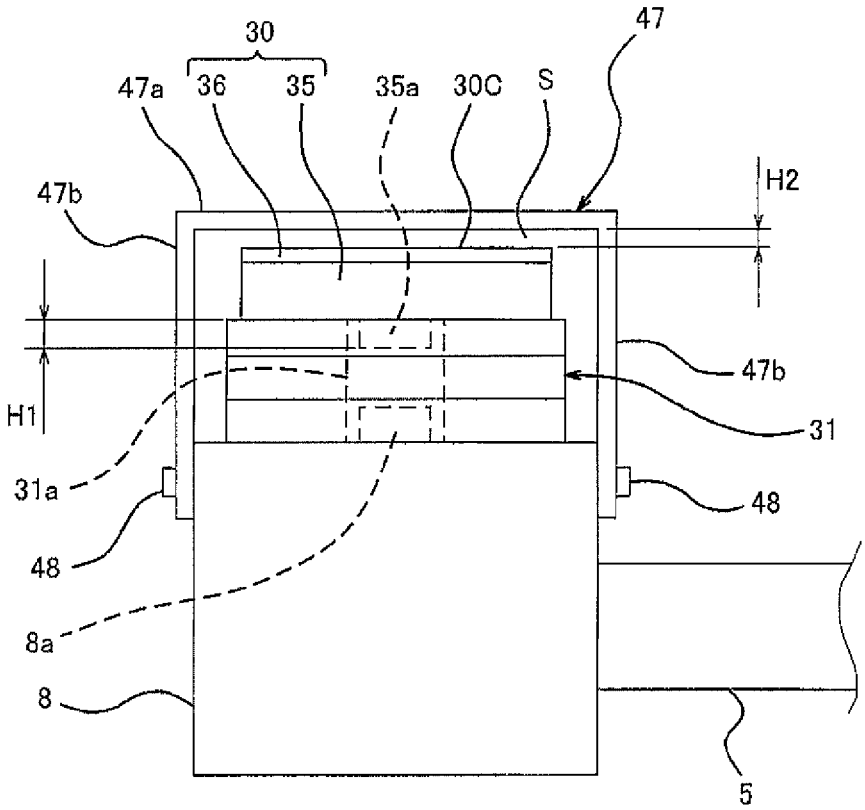
FIG. 8 is a main portion rear view for explaining the attachment of a cover to the axle box shown in FIG. 7.

FIG. 7 is a main portion side view showing the plate spring 30 and the spring seat 31 of the axle box 8 in the bogie 1 shown in FIG. 3. FIG. 8 is a main portion rear view for explaining the attachment of a cover 47 to the axle box 8 shown in FIG. 7. As shown in FIGS. 7 and 8, the spring seat 31 is disposed on the upper end portion of the axle box 8. A hole portion 31*a* is formed at a center of the spring seat 31, and a convex portion 8*a* provided on the axle box 8 is fitted in the hole portion 31*a*. The spring seat 31 is formed by stacking a rubber plate 41, a metal plate 42, and a rubber plate 43 in this order from below such that these plates 41 to 43 are adhered to one another. The front-rear direction end portion 30*c* of the plate spring 30 is disposed on the spring seat 31 from above so as to freely contact the spring seat 31. In other words, the front-rear direction end portion 30*c* of the plate spring 30 contacts an upper surface of the spring seat 31 so as not to be fixed to the spring seat 31 in the upper-lower direction. A concave-convex fitting structure including fitting portions that are fitted to each other in the upper-lower direction with a play is provided at a portion where the contact surface 33*a* (upper surface) of the spring seat 31 and the lower surface of the plate spring 30 contact each other. Specifically, a convex portion 35*a* projecting downward integrally from the lower layer portion 35 is formed at the front-rear direction end portion 30*c* of the plate spring 30, and the convex portion 35*a* is fitted in the hole portion 31*a* of the spring seat 31 with a play.

As shown in FIG. 8, the cover 47 (not shown in FIGS. 1 to 3 and 7) having an inverted U-shaped cross section is provided at the axle box 8 so as to cover an upper side of the front-rear direction end portion 30*c* of the plate spring 30 with a space S between the cover 47 and the front-rear direction end portion 30*c*. The cover 47 includes an upper wall portion 47*a* and side wall portions 47*b* respectively extending downward from both crosswise direction end portions of the upper wall portion 47*a*. The lower end portions of the side wall portions 47*b* are fixed to the axle box 8 by fixtures 48, such as screws. The space S between the upper wall portion 47*a* of the cover 47 and the plate spring 30 is set so as to maintain the fit state of the concave-convex fitting structure between the plate spring 30 and the spring seat 31 and the fit state of the concave-convex fitting structure between the spring seat 31 and the axle box 8. Specifically, a height H2 of the space S is set to be lower than a height H1 of each of the convex portions 8*a* and 35*a*.

According to the above-explained configuration, if the plate spring 30 is, for example, damaged, and this causes the crosswise direction end portion 4*a* of the cross beam 4 to be displaced downward beyond the predetermined elastic deformation range of the plate spring 30, the auxiliary supporting members 29 position the plate spring 30 by sandwiching the plate spring 30 between each auxiliary supporting member 29 and the end portion 4*a* of the cross beam 4 in the upper-lower direction. Thus, the auxiliary supporting members 29 support the end portion 4*a* of the cross beam 4. Therefore, the required supporting function can be ensured by the first auxiliary supporting members 29. On this account, even if the plate spring 30 of the bogie 1 is, for example, damaged, the cross beam 4 can be appropriately supported. Thus, the reliability of the bogie 1 can be improved.

When the end portion 4*a* of the cross beam 4 is displaced in the upper-lower direction within the normal elastic deformation range of the plate spring 30, the first auxiliary supporting members 29 are spaced apart from the plate spring 30, that is, do not support the end portion 4*a* of the cross beam 4. Therefore, the design of the spring constant of the plate spring 30 becomes easy. In addition, when the plate spring is in a normal elastic deformation state, the load is not applied from the plate spring 30 to the first auxiliary supporting members 29, so that the fatigue of the first auxiliary supporting members 29 can be prevented. The first auxiliary supporting members 29 are respectively provided at the front side and rear side when viewed from the front-rear direction center of the spring 30. Therefore, even in a case where any length direction portion of the plate spring 30 is damaged, the auxiliary supporting members 29 can support the end portion 4*a* of the cross beam 4 via the plate spring 30.

The auxiliary supporting mechanism 50 is provided separately from the coupling mechanism 16. Therefore, if the plate spring 30 is, for example, damaged, the downward load is not excessively transmitted from the cross beam 4 to the coupling mechanism 16. Thus, the excessive load is prevented from being applied to the coupling mechanism 16. The cover 47 is provided at the axle box 8 so as to cover the upper side of the front-rear direction end portion 30*c* of the plate spring 30 with the space S between the cover 47 and the upper surface of the front-rear direction end portion 30*c* of the plate spring 30, and the space S is set so as to maintain the fit state of the concave-convex fitting structure between the plate spring 30 and the spring seat 31. Therefore, even if the plate spring 30 is damaged, the plate spring 30 can be prevented from falling off.

Embodiment 2

Figure 9:
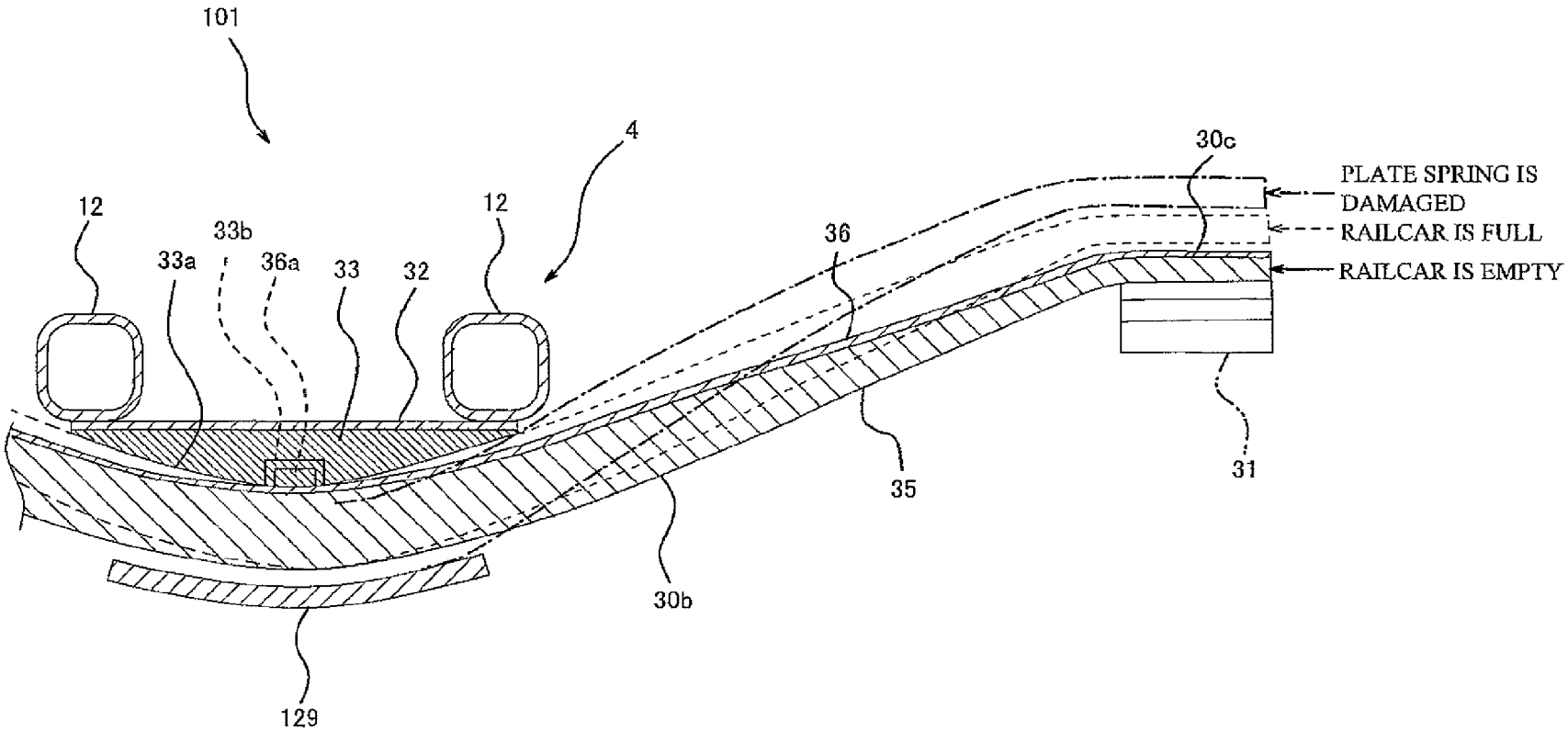
FIG. 9 is a diagram showing the bogie according to Embodiment 2 of the present invention and corresponds to FIG. 5.

FIG. 9 is a diagram showing a bogie 101 according to Embodiment 2 of the present invention and corresponds to FIG. 5. As shown in FIG. 9, an auxiliary supporting member 129 of the present embodiment is a plate-shaped member arranged under the plate spring 30 so as to overlap the end portion 4*a* of the cross beam 4 in a plan view. The auxiliary supporting member 129 is arranged so as to be spaced apart from the plate spring 30 and curves along the lower surface of the plate spring 30. A front-rear direction length of the auxiliary supporting member 129 is shorter than a front-rear direction length of the contact member 33 of the end portion 4*a* of the cross beam 4. In a case where the plate spring 30 is not damaged, and the end portion 4*a* of the cross beam 4 is normally displaced in the upper-lower direction within the predetermined elastic deformation range of the plate spring 30, the auxiliary supporting member 129 is spaced apart from the plate spring 30, that is, does not support the end portion 4*a* of the cross beam 4.

According to the above configuration, as with Embodiment 1, if the plate spring 30 is, for example, damaged, and this causes the crosswise direction end portion 4*a* of the cross beam 4 to be displaced downward beyond the predetermined elastic deformation range of the plate spring 30, the auxiliary supporting member 129 positions the plate spring 30 by sandwiching the plate spring 30 between the auxiliary supporting member 129 and the end portion 4*a* of the cross beam 4 in the upper-lower direction. Thus, the auxiliary supporting member 129 supports the end portion 4*a* of the cross beam 4. Therefore, the required supporting function can be ensured by the auxiliary supporting member 129. Since the other components herein are the same as those in Embodiment 1, explanations thereof are omitted.

Embodiment 3

Figure 10:
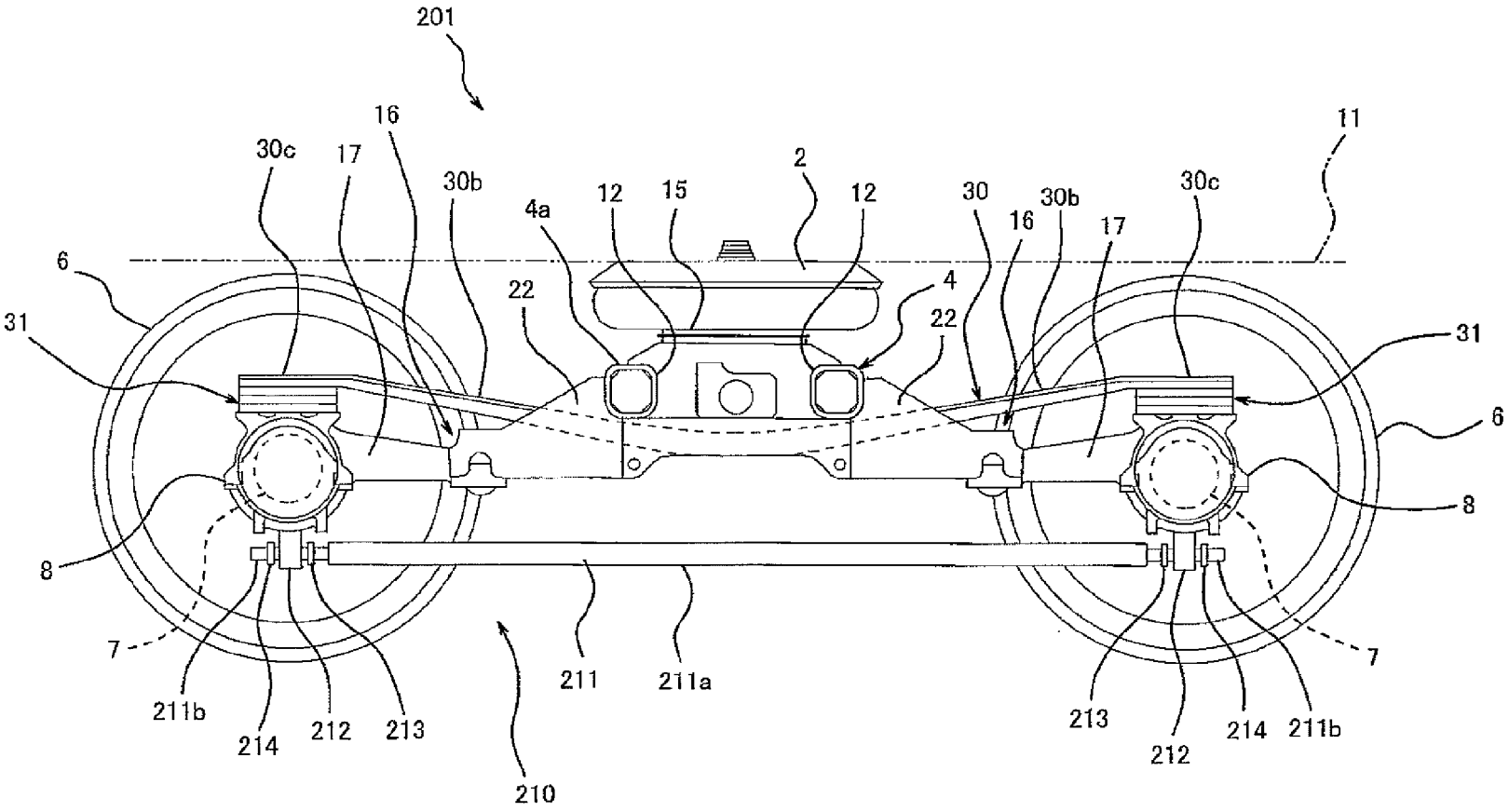
FIG. 10 is a side view showing the bogie according to Embodiment 3 of the present invention.
Figure 11:
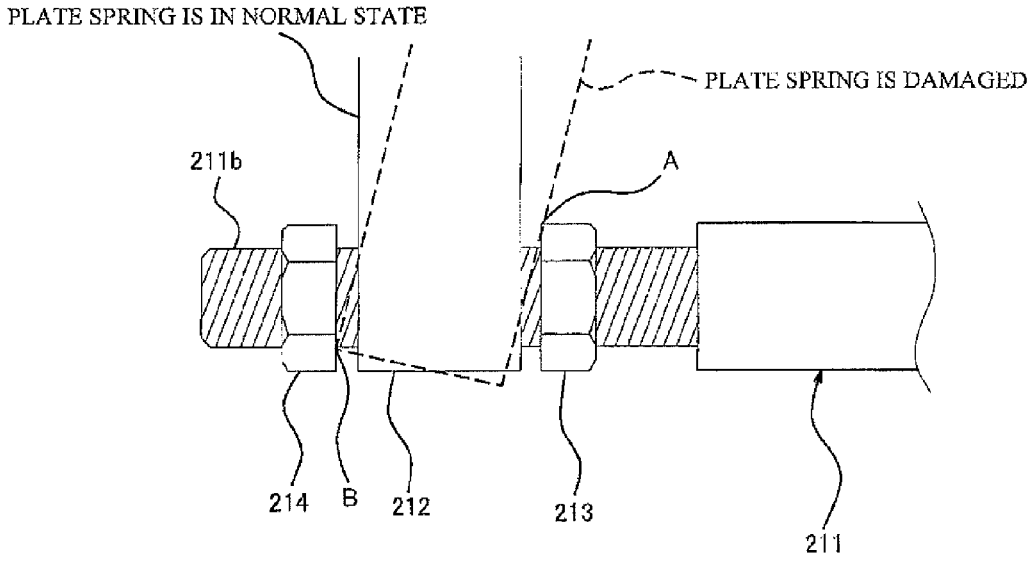
FIG. 11 is a main portion enlarged view of the plate spring bogie shown in FIG. 10.

FIG. 10 is a side view of a bogie 201 according to Embodiment 3 of the present invention. FIG. 11 is a main portion enlarged view of the bogie 201 shown in FIG. 10. As shown in FIGS. 10 and 11, a receiving frame 212 having a substantially U shape when viewed from the front-rear direction is vertically provided at each axle box 8 so as to extend downward. A rod 211 extends between the receiving frame 212 at the front side and the receiving frame 212 at the rear side. The rod 211 includes a rod main body portion 211*a* and front-rear direction end portions 211*b* respectively located at the front side and rear side of the rod main body portion 211*a*, and threads are formed on outer peripheral surfaces of the end portions 211*b*. Stoppers 213 and 214 that are nuts are threadedly engaged with each of the end portions 211*b* of the rod 211 inserted in internal spaces of the receiving frames 212, so as to be respectively located at both front-rear direction sides of the receiving frame 212. Each of the stoppers 213 and 214 is too big to pass through the internal space of the receiving frame 212 and is arranged so as to be separated from the receiving frame 212 by a predetermined distance in the front-rear direction. Thus, the rod 211, the receiving frames 212, and the stoppers 213 and 214 constitute an auxiliary supporting mechanism 210.

According to the above configuration, in a case where the end portion 4*a* of the cross beam 4 is displaced downward beyond the normal elastic deformation range of the plate spring 30, this displacement is transmitted through the coupling mechanism 16 to the axle box 8, and this causes the axle box 8 to rotate around the axle (in a pitch direction). In this case, the receiving frame 212 inclines to contact the stoppers 213 and 214 at points A and B (broken line in FIG. 11). Thus, the rotation angle of the axle box 8 around the axle is limited within a predetermined angular range. As above, even if the plate spring 30 is, for example, damaged, the stoppers 213 and 214 can prevent the axle box 8 from rotating to support the end portion 4*a* of the cross beam 4 via the coupling mechanism 16. Since the other components herein are the same as those in Embodiment 1, explanations thereof are omitted.

Embodiment 4

Figure 12:
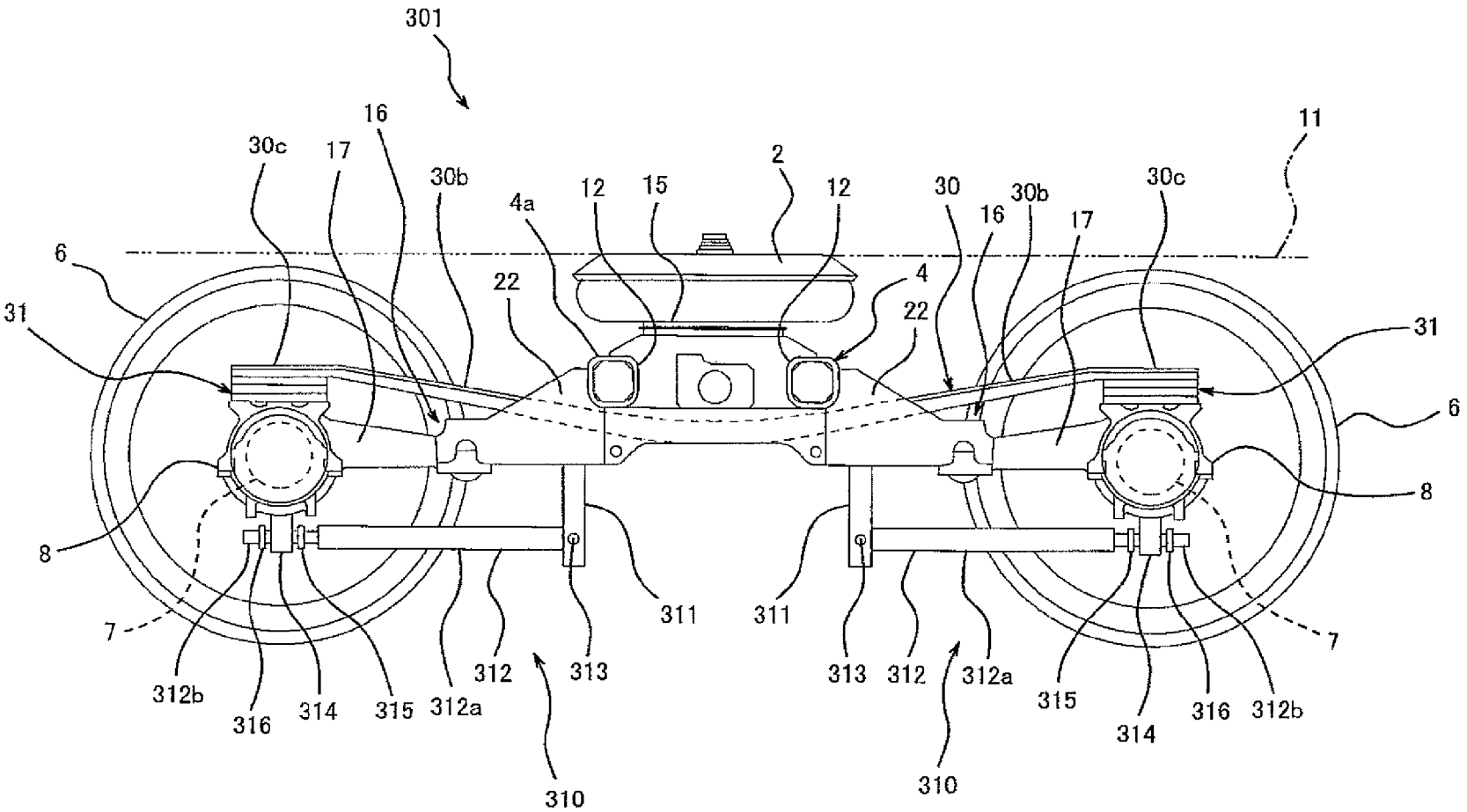
FIG. 12 is a side view showing the bogie according to Embodiment 4 of the present invention.

FIG. 12 is a side view of a bogie 301 according to Embodiment 4 of the present invention. As shown in FIG. 12, a pair of front and rear brackets 311 extend downward integrally from the cross beam 4. A base end portion of a rod 312 extending toward the axle box 8 is connected to a lower end portion of each of the brackets 311 via a support shaft 313 such that the rod 312 can swing in the upper-lower direction. Threads are formed on an outer peripheral surface of a tip end portion 312*b* of each rod 312, the tip end portion 312*b* being located at the axle box 8 side. A receiving frame 314 having a substantially U shape when viewed from the front-rear direction is vertically provided at each axle box 8. The tip end portion 312*b* of the rod 312 is inserted through an internal space of the receiving frame 314. Stoppers 315 and 316 that are nuts are threadedly engaged with the tip end portion 312*b* of each rod 312 so as to be respectively located at both front-rear direction sides of the receiving frame 314. Each of the stoppers 315 and 316 is too big to pass through the internal space of the receiving frame 314 and is arranged so as to be separated from the receiving frame 314 by a predetermined distance in the front-rear direction. Thus, the bracket 311, the rod 312, the support shaft 313, the receiving frame 314, and the stoppers 315 and 316 constitute an auxiliary supporting mechanism 310.

According to the above configuration, as with Embodiment 3, in a case where the end portion 4*a* of the cross beam 4 is displaced downward beyond the normal elastic deformation range of the plate spring 30, and this causes the axle box 8 to rotate around the axle, the receiving frame 314 inclines to contact the stoppers 315 and 316. Thus, the rotation angle of the axle box 8 around the axle is limited within a predetermined angular range. Therefore, even if the plate spring 30 is, for example, damaged, the stoppers 315 and 316 can prevent the axle box 8 from rotating to support the end portion 4*a* of the cross beam 4 via the coupling mechanism 16. Since the other components herein are the same as those in Embodiment 1, explanations thereof are omitted.

Embodiment 5

Figure 13:
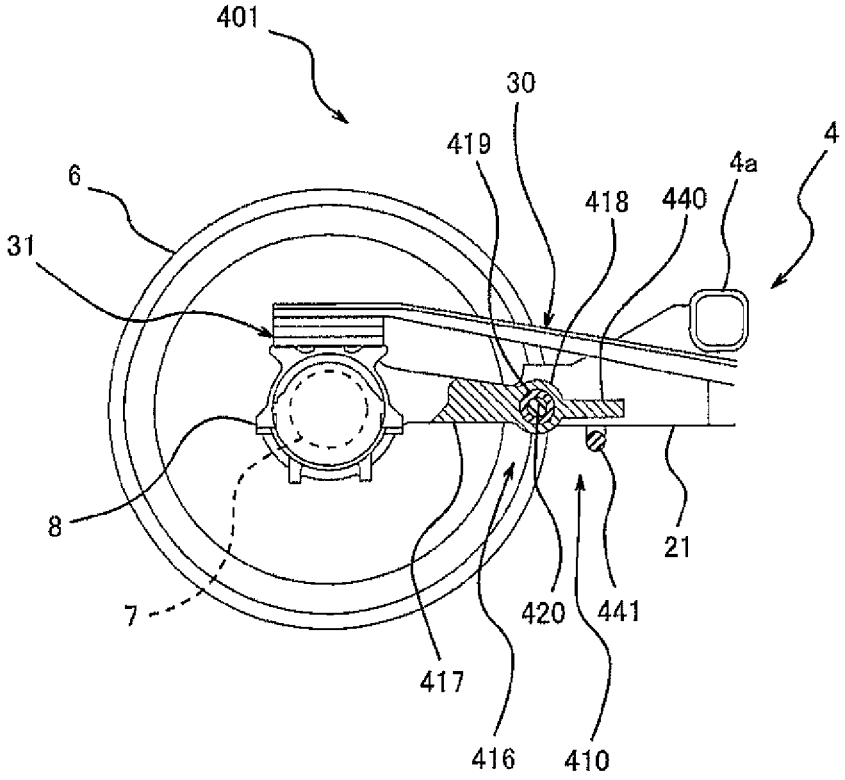
FIG. 13 is a main portion side view showing the bogie according to Embodiment 5 of the present invention, a part of the side view being a cross-sectional view.

FIG. 13 is a main portion side view showing a bogie 401 according to Embodiment 5 of the present invention, a part of the side view being a cross-sectional view. As shown in FIG. 13, a coupling mechanism 416 of the bogie 401 includes an axle beam 417 extending in the front-rear direction integrally from the axle box 8. A tubular portion 418 that has a cylindrical inner peripheral surface and opens at both crosswise direction sides thereof is provided at a tip end side of the axle beam 417. A core rod 420 is inserted through an internal space of the tubular portion 418 via a rubber bushing 419. Further, the axle beam 417 integrally includes an overhang portion 440 projecting from the tubular portion 418 toward a side opposite to the axle box 8. A stopper 441 having a substantially U shape when viewed from the front-rear direction is provided under the overhang portion 440 so as to be integral with the cross beam 4. The stopper 441 is provided so as to be spaced apart from the overhang portion 440 by a predetermined distance. Thus, the overhang portion 440 and the stopper 441 constitute an auxiliary supporting mechanism 410.

In a case where the end portion 4*a* of the cross beam 4 is displaced downward beyond the normal elastic deformation range of the plate spring 30, and this causes the axle box 8 to rotate around the axle, the overhang portion 440 inclines to contact the stopper 441. Thus, the rotation angle of the axle box 8 around the axle is limited within a predetermined angular range. Therefore, even if the plate spring 30 is, for example, damaged, the stopper 441 can prevent the axle box 8 from rotating to support the end portion 4*a* of the cross beam 4 via the coupling mechanism 416. Since the other components herein are the same as those in Embodiment 1, explanations thereof are omitted.

Embodiment 6

Figure 14:
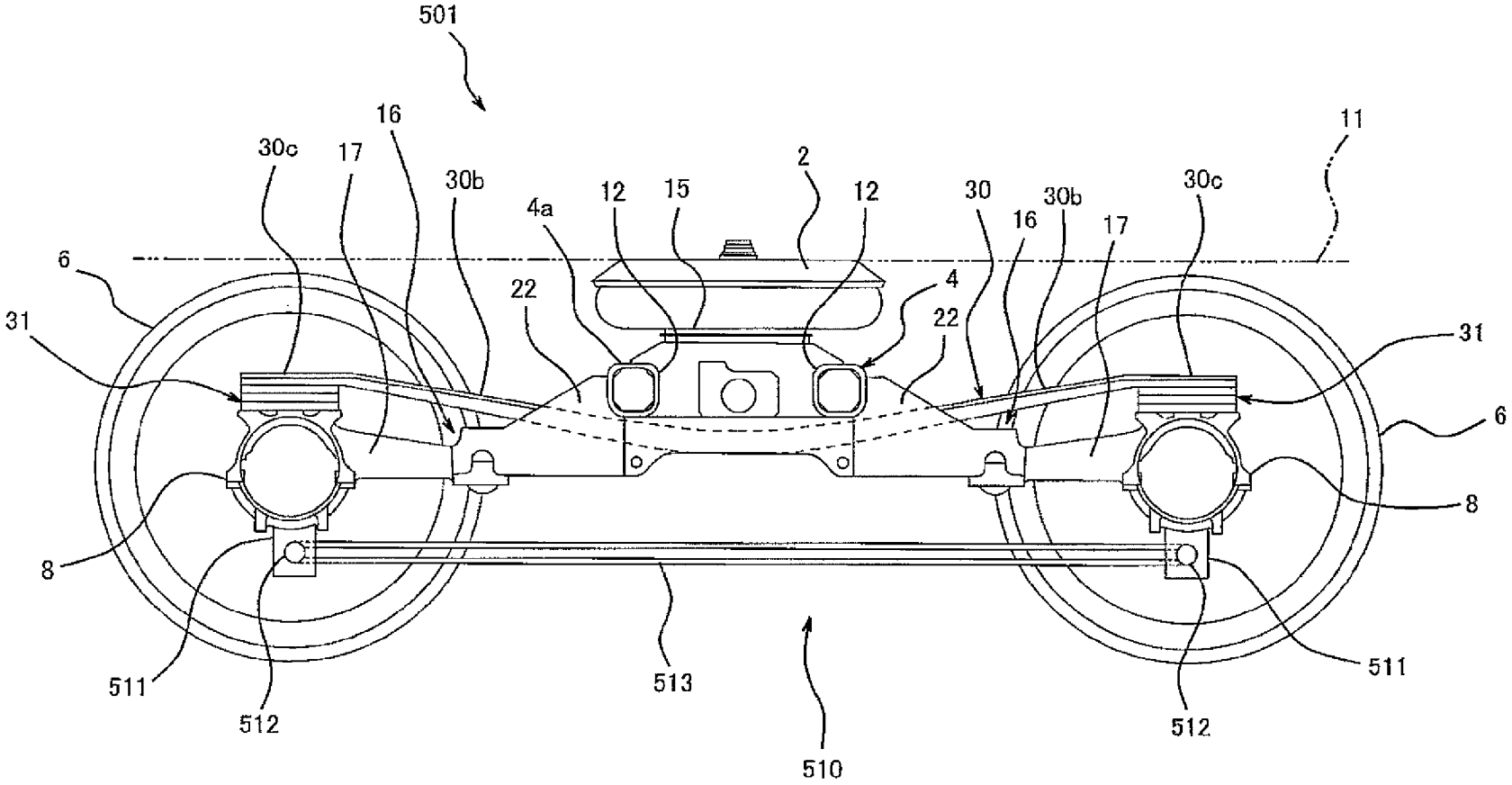
FIG. 14 is a side view of the bogie according to Embodiment 6 of the present invention.

FIG. 14 is a side view of a bogie 501 according to Embodiment 6 of the present invention. As shown in FIG. 14, a hoop 513 that is a stopper extends between the axle box 8 at the front side and the axle box 8 at the rear side so as to be located under the end portion 4*a* of the cross beam 4 and extend in the front-rear direction. Specifically, a pair of left and right brackets 511 are vertically provided at each axle box 8 so as to extend downward. A pin 512 extends between the brackets 511 such that an axial direction thereof corresponds to the railcar width direction. The hoop 513 that is an endless belt-shaped body extends between the pin 512 at the front side and the pin 512 at the rear side so as to be slightly slackened. The hoop 513 is made of, for example, fiber-reinforced resin. When the plate spring 30 is in the normal elastic deformation state, the hoop 513 is slightly slackened, so that the hoop 513 does not practically support the load applied from the cross beam 4. Thus, the brackets 511, the pins 512, and the hoop 513 constitute an auxiliary supporting mechanism 510.

In a case where the end portion 4*a* of the cross beam 4 is displaced downward beyond the normal elastic deformation range of the plate spring 30, and this causes the axle box 8 to significantly rotate around the axle, the distance between the pin 512 at the front side and the pin 512 at the rear side increases. However, when a tension is applied from the pins 512 to the hoop 513, this increase of the distance is stopped by the hoop 513. To be specific, the rotation angle of the axle box 8 around the axle is limited within the predetermined angular range by the hoop 513. Therefore, even if the plate spring 30 is, for example, damaged, the hoop 513 as the stopper can prevent the axle box 8 from rotating to indirectly support the end portion 4*a* of the cross beam 4.

Embodiment 7

Figure 15:
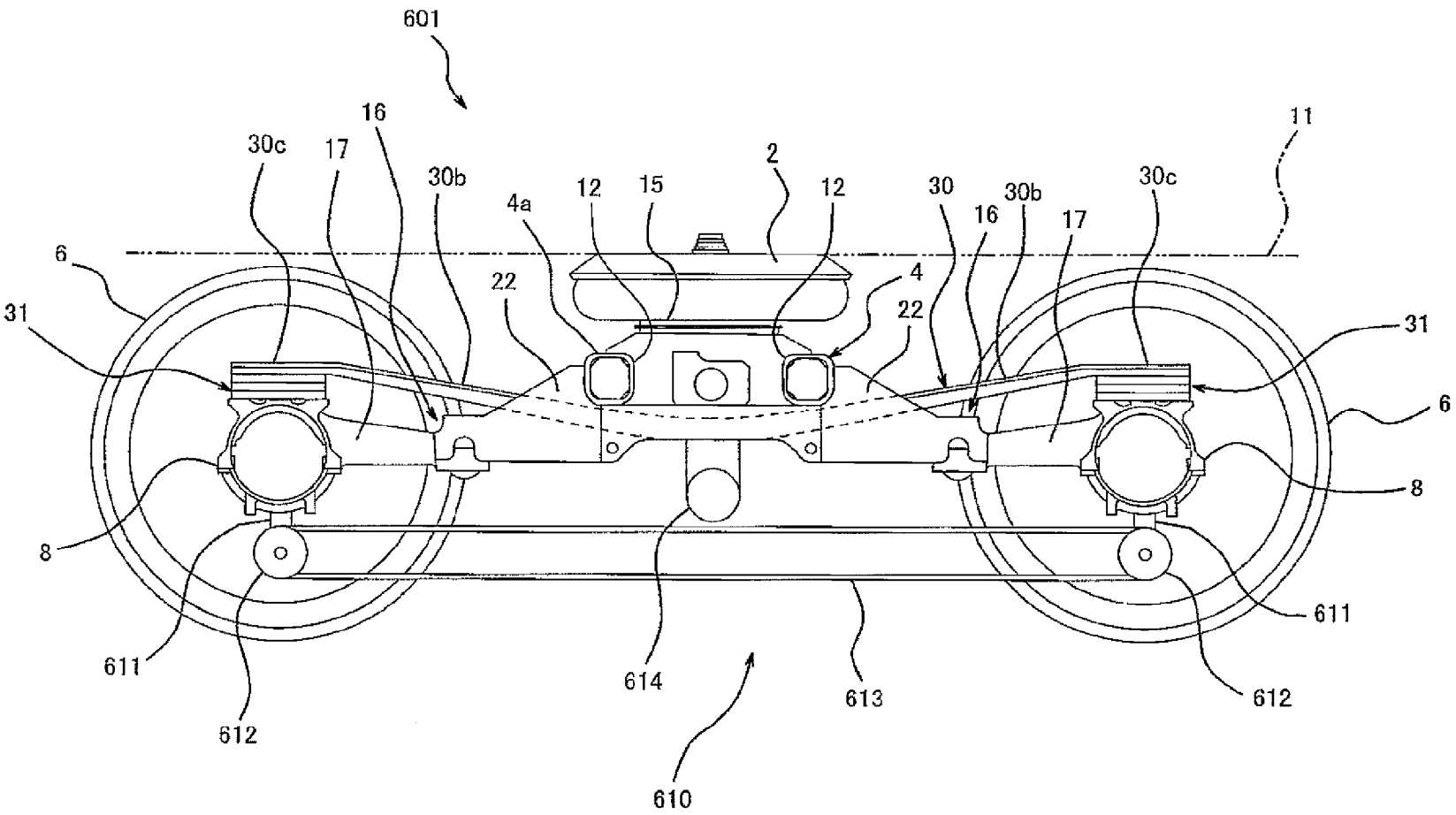
FIG. 15 is a side view of the bogie according to Embodiment 7 of the present invention.

FIG. 15 is a side view of a bogie 601 according to Embodiment 7 of the present invention. As shown in FIG. 15, a hoop 613 that is a second auxiliary supporting member extends between the axle box 8 at the front side and the axle box 8 at the rear side so as to be located under the end portion 4*a* of the cross beam 4 and extend in the front-rear direction. Specifically, brackets 611 are respectively, vertically provided at the axle boxes 8 so as to extend downward, and pulleys 612 are respectively, rotatably provided at the brackets 611. The hoop 613 extends between the pulley 612 at the front side and the pulley 612 at the rear side so as to be slightly slackened. The hoop 613 is made of, for example, fiber-reinforced resin. A supported portion 614 extending downward integrally from the cross beam 4 is provided immediately above a front-rear direction middle portion of the hoop 613.

When the plate spring 30 is in the normal elastic deformation state, there is a gap between the supported portion 614 and the hoop 613, or the supported portion 614 slightly contacts the hoop 613. The hoop 613 extends between the pulleys 612 so as to be slackened. Therefore, even if the supported portion 614 slightly contacts the hoop 613, the hoop 613 does not practically support the supported portion 614. Thus, the brackets 611, the pulleys 612, the hoop 613, and the supported portion 614 constitute an auxiliary supporting mechanism 610.

According to the above configuration, in a case where the end portion 4*a* of the cross beam 4 is displaced downward beyond the normal elastic deformation range of the plate spring 30, the supported portion 614 that moves downward together with the cross beam 4 is received and supported from below by the front-rear direction middle portion of the hoop 613. Thus, the supported portion 614 is supported by the tension of the hoop 613. Therefore, even if the plate spring 30 is, for example, damaged, the hoop 613 can support the end portion 4*a* of the cross beam 4.

Embodiment 8

Figure 16:
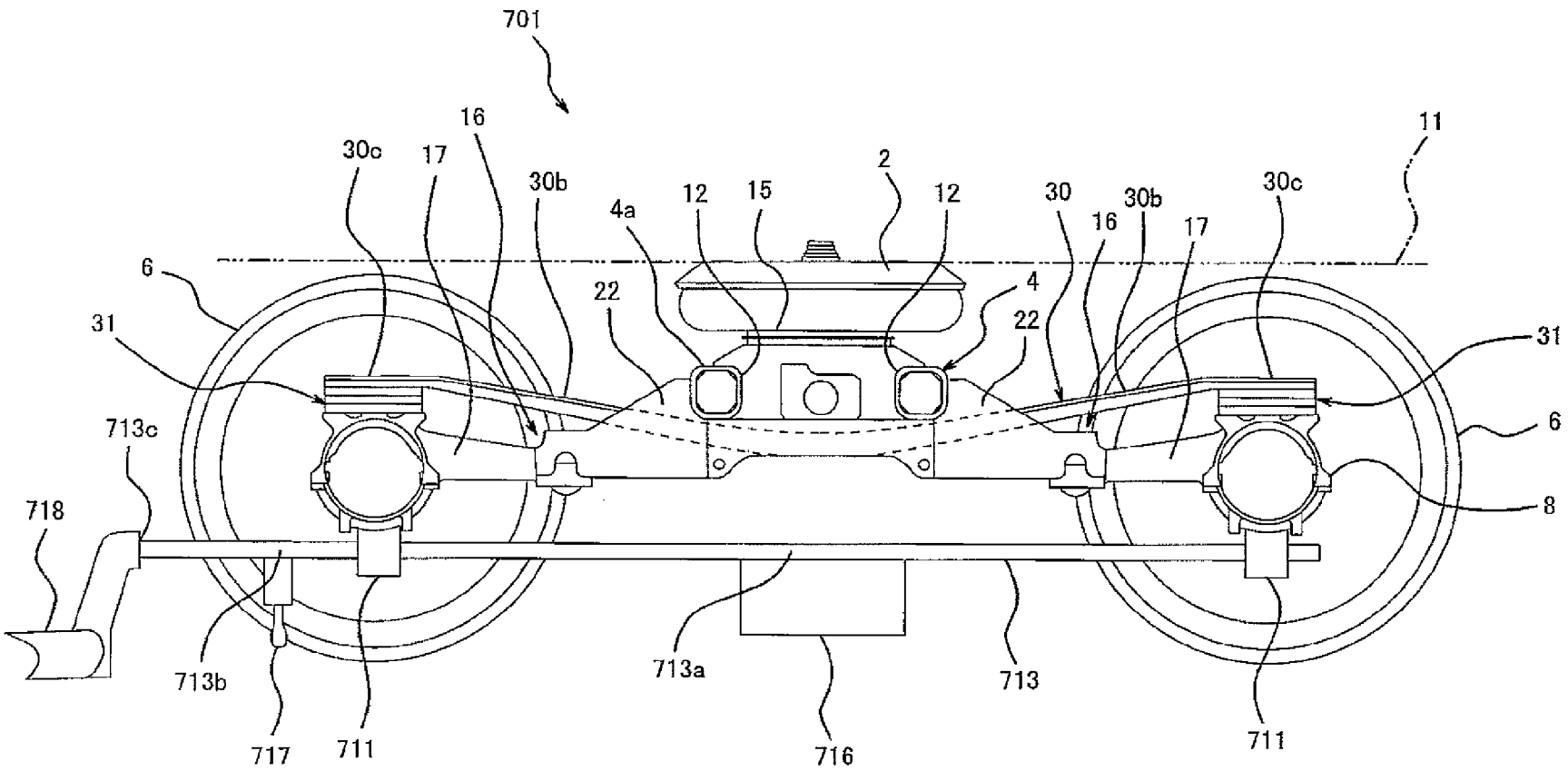
FIG. 16 is a side view of the bogie according to Embodiment 8 of the present invention.
Figure 17:
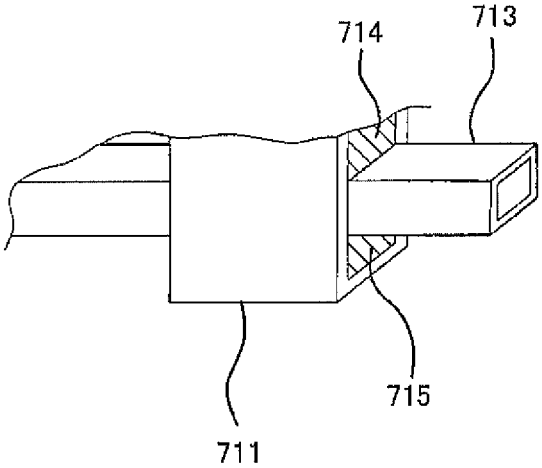
FIG. 17 is a main portion perspective view of the bogie shown in FIG. 16.

FIG. 16 is a side view of a bogie 701 according to Embodiment 8 of the present invention. FIG. 17 is a main portion perspective view of the bogie 701 shown in FIG. 16. As shown in FIGS. 16 and 17, a bar member 713 that is a stopper extends between the axle box 8 at the front side and the axle box 8 at the rear side so as to be located under the end portion 4*a* of the cross beam 4 and extend in the front-rear direction. Specifically, tubular insertion frames 711 are respectively, vertically provided at the axle boxes 8 so as to extend downward. The bar member 713 extending in the front-rear direction and having a square pipe shape is inserted through the insertion frames 711. Elastic members 714 and 715 (such as rubber) are inserted into each insertion frame 711 so as to sandwich the bar member 713 in the upper-lower direction. With this, when the plate spring 30 is in the normal elastic deformation state, the axle box 8 may rotate around the axle such that the bar member 713 does not contact the insertion frames 711. Thus, the insertion frames 711, the elastic members 714 and 715, and the bar member 713 constitute an auxiliary supporting mechanism 710.

In a case where the end portion 4*a* of the cross beam 4 is displaced downward beyond the normal elastic deformation range of the plate spring 30, and this causes the axle box 8 to significantly rotate around the axle, the insertion frames 711 incline to contact the bar member 713 via the elastic bodies 714 and 715. Thus, the rotation angle of the axle box 8 around the axle is limited within the predetermined angular range. Therefore, even if the plate spring 30 is, for example, damaged, the bar member 713 as the stopper can prevent the axle box 8 from rotating to indirectly support the end portion 4*a* of the cross beam 4.

Attaching portions 713*a*, 713*b*, and 713*c* to which peripheral devices are attached are provided at the bar member 713. For example, at least one of a current collector 716, a trip cock 717, and a rail guard 718 (snow removing unit) is attached to the bar member 713. In this case, by forming the bar member 713 in a square pipe shape, the attaching portions 713*a*, 713*b*, and 713*c* to which the peripheral devices are attached can be formed at the bar member 713 more easily than a case where the bar member 713 is formed in, for example, a round pipe shape. Various fixing methods can be used as a method of attaching the peripheral device to the bar member 713. For example, in the case of using bolt fixation, the attaching portions 713*a*, 713*b*, and 713*c* may be provided as bolt holes.

The current collector 716 is used as a third rail type current collection device. To prevent a current collection wire from increasing in length, the current collector 716 is provided at a front-rear direction middle portion of the bogie 701. The trip cock 717 is a part of a protective device and is arranged at a proceeding direction front left side of the bogie 701. When a stop signal is input to the railcar from outside, a train stopper located beside a railway track in a railcar proceeding direction stands up. However, if the railcar runs beyond a stop position, the trip cock 717 of the railcar hits the train stopper on the ground. Thus, an emergency brake is activated. The rail guard 718 (snow removing unit) is used to remove obstacles in front or snow on the ground and is attached to the tip end portion of the bar member 713.

The present invention is not limited to the above embodiments, and modifications, additions, and eliminations may be made within the scope of the present invention. The above embodiments may be combined arbitrarily. For example, a part of components or methods in one embodiment may be applied to another embodiment.

INDUSTRIAL APPLICABILITY

As above, the railcar bogie according to the present invention has an excellent effect of being able to appropriately support the cross beam even if the plate spring of the bogie is, for example, damaged, and to improve the reliability of the bogie. Thus, it is useful to widely apply the railcar bogie according to the present invention to railcars that can utilize the significance of the above effect.

REFERENCE SIGNS LIST

1, 101, 201, 301, 401, 501, 601, 701 bogie
4 cross beam
5 axle
7 bearing
8 axle box
11 carbody
16 coupling mechanism
29, 129 auxiliary supporting member
30 plate spring
31 spring seat
47 cover
50, 210, 310, 410, 510, 610, 710 auxiliary supporting mechanism
213, 214, 315, 316, 441 stopper
513, 613 hoop
713 bar member (stopper)
716 current collector (peripheral device)
717 trip cock (peripheral device)
718 rail guard (peripheral device)

The invention claimed is:

1. A railcar bogie comprising:

a cross beam configured to support a carbody of a railcar, the cross beam extending in a railcar width direction;

a pair of front and rear axles between which the cross beam is disposed, the front and rear axles being respectively arranged in front of and behind the cross beam in a railcar longitudinal direction so as to extend in the railcar width direction;

bearings respectively provided at both railcar width direction sides of each of the axles and configured to rotatably support the axles:

axle boxes configured to respectively accommodate the bearings;

coupling mechanisms configured to couple the axle boxes to the cross beam;

plate springs extending in the railcar longitudinal direction so as to respectively support both railcar width direction end portions of the cross beam and each including both railcar longitudinal direction end portions respectively supported by the axle boxes; and an auxiliary supporting mechanism configured to support at least one of the railcar width direction end portions of the cross beam in a case where said one end portion of the cross beam is displaced downward beyond a predetermined elastic deformation range of the plate spring, wherein:

the auxiliary supporting mechanism includes stoppers each configured to limit a rotation angle of the axle box around the axle within a predetermined angular range;

in a case where the plate spring is within the elastic deformation range, there is a gap between each of the stoppers and a portion provided integrally with the axle box; and in a case where the railcar width direction end portion of the cross beam is displaced downward beyond the elastic deformation range of the plate spring, and this causes the axle box to rotate around the axle, each of the stoppers contacts the portion provided integrally with the axle box, to prevent the axle box from rotating, thereby supporting the railcar width direction end portion of the cross beam via the coupling mechanism.

2. The railcar bogie according to claim 1, wherein:

the auxiliary supporting mechanism further includes a front receiving frame extending downward from the axle box located at a front side in the railcar longitudinal direction, a rear receiving frame extending downward from the axle box located at a rear side in the railcar longitudinal direction, and a rod extending between the front receiving frame and the rear receiving frame and inserted through internal spaces of the receiving frames;

the stoppers are threadedly engaged with the rod at both front-rear direction sides of each of the receiving frames;

each of the stoppers is too big to pass through the internal space of the receiving frame;

there is the gap between each of the stoppers and the corresponding receiving frame in a front-rear direction;

in a case where the plate spring is within the elastic deformation range, there is the gap between each of the stoppers and the corresponding receiving frame; and in a case where the railcar width direction end portion of the cross beam is displaced downward beyond the elastic deformation range of the plate spring, and this causes the axle box to rotate around the axle, each of the stoppers contacts the corresponding receiving frame to prevent the axle box from rotating.

3. The railcar bogie according to claim 1, wherein:

the auxiliary supporting mechanism further includes a front receiving frame extending downward from the axle box located at a front side, a rear receiving frame extending downward from the axle box located at a rear side, a pair of front and rear brackets each extending downward integrally from the cross beam, a front rod connected to the front bracket and inserted through an internal space of the front receiving frame, and a rear rod connected to the rear bracket and inserted through an internal space of the rear receiving frame;

the stoppers are threadedly engaged with the rods at both front-rear direction sides of each of the receiving frames;

each of the stoppers are too big to pass through the internal space of the receiving frame;

there is the gap between each of the stoppers and the corresponding receiving frame in a front-rear direction;

in a case where the plate spring is within the elastic deformation range, there is the gap between each of the stoppers and the corresponding receiving frame; and in a case where the railcar width direction end portion of the cross beam is displaced downward beyond the elastic deformation range of the plate spring, and this causes the axle box to rotate around the axle, each of the stoppers contacts the corresponding receiving frame to prevent the axle box from rotating.

4. The railcar bogie according to claim 1, wherein:

the coupling mechanisms respectively include axle beams extending in a front-rear direction integrally from the axle boxes;

the auxiliary supporting mechanism further includes overhang portions respectively projecting integrally from the axle beams;

in a case where the plate spring is within the elastic deformation range, there is a gap between each of the stoppers and the corresponding overhang portion; and in a case where the railcar width direction end portion of the cross beam is displaced downward beyond the elastic deformation range of the plate spring, and this causes the axle box to rotate around the axle, each of the stoppers contacts the corresponding overhang portion to prevent the axle box from rotating.

5. The railcar bogie according claim 1, wherein:

spring seats each configured to support a front-rear direction end portion of the plate spring are respectively provided at upper end portions of the axle boxes;

the railcar longitudinal direction end portions of the plate springs are respectively disposed on the spring seats from above to respectively contact upper surfaces of the spring seats;

fitting portions that are fitted to each other in an upper-lower direction with a play are provided at each of portions at each of which a lower surface of the front-rear direction end portion of the plate spring and the upper surface of the spring seat contact each other; and covers each configured to cover the railcar longitudinal direction end portion of the plate spring are respectively provided at the axle boxes so as to each maintain a fit state between the fitting portions and be spaced apart from an upper surface of the plate spring.

6. The railcar bogie according to claim 1, wherein:

the auxiliary supporting mechanism includes a bar member extending in the railcar longitudinal direction; and an attaching portion to which a peripheral device is attached is provided at the bar member.

* * * * *